United States Patent [19]

McNabney

[11] 4,249,571

[45] Feb. 10, 1981

[54] AIR CONTROL MECHANISM HAVING NOISE SUPPRESSION MEANS

[75] Inventor: John C. McNabney, Verona, Wis.

[73] Assignee: Wehr Corporation, Milwaukee, Wis.

[21] Appl. No.: 27,674

[22] Filed: Apr. 6, 1979

[51] Int. Cl.[3] ..... F23L 13/08

[52] U.S. Cl. ..... 137/601; 98/121 A; 98/DIG. 10; 181/224; 181/227

[58] Field of Search ..... 98/40 R, 40 V, 40 VM, 98/41 R, 110, 121 A, DIG. 10; 137/601; 181/224, 226; 49/91

[56] References Cited

U.S. PATENT DOCUMENTS

| | | | |
|---|---|---|---|
| 2,974,745 | 3/1961 | Kristiansen | 181/224 |
| 3,047,914 | 8/1962 | Kahn | 49/91 X |
| 3,059,564 | 10/1962 | Curran | 181/224 X |
| 3,330,379 | 7/1967 | Cook | 181/224 |
| 3,366,141 | 1/1968 | Foster | 137/625.31 |
| 3,495,521 | 2/1970 | Foster | 98/41 |
| 3,554,111 | 1/1971 | Traver | 98/40 R |
| 3,908,529 | 9/1975 | McCabe | 98/110 |
| 4,038,781 | 8/1977 | Graham | 49/91 |

FOREIGN PATENT DOCUMENTS

| | | | |
|---|---|---|---|
| 1126115 | 3/1962 | Fed. Rep. of Germany | 49/91 |

*Primary Examiner*—Robert G. Nilson

[57] ABSTRACT

The invention provides an airflow control mechanism for use in an air duct for controlling airflow through the duct. The air flow control mechanism includes a frame positionable in the duct, and a plurality of blades supported by the frame and extending transversely to the direction of the air flow through the air duct. At least one of the blades is supported for pivotal movement about its longitudinal axis and has an elongated edge moveable toward and away from an elongated edge of another of the blades to restrict air flow through the duct. A fiber material strip is applied to at least one of those edges, the fiber material strip including a substrate bonded to that edge and a plurality of closely spaced fibers projecting transversely from the substrate, the fiber covering being functional to prevent the generation of a high frequency standing wave between the adjacent surfaces of the blade.

8 Claims, 4 Drawing Figures

AIR CONTROL MECHANISM HAVING NOISE SUPPRESSION MEANS

BACKGROUND OF THE INVENTION

The invention relates to air valves and other air flow control mechanisms of the type used in air flow ducts such as those employed in heating and air conditioning systems. More particularly, the invention relates to air flow control mechanisms having at least one moveable blade, the blade having a surface sealable against an adjacent surface when the air valve or air control mechanism is closed.

In air valves and other air flow control mechanisms of the type used in air conditioning and heating ducts and which include at least one pivotable or moveable blade, when the blade is moved to an air flow restricting position and when the static pressure in the ducts is relatively high, air flow between the blade surface and an adjacent surface can result in noise in the form of a high pitched, pure tone such as a whistle. Such tones are usually caused when the gap or space between the blade and the adjacent surface approaches zero. The noise results when the air passes between two closely adjacent smooth surfaces and when those surfaces permit air to vibrate therebetween at a resonant frequency, thereby generating a standing wave between the adjacent surfaces, the standing wave providing the audible high frequency pitch or tone. While such audible tones or whistles are produced by smooth flat surfaces, similar audible tones are also produced if the adjacent surfaces are defined by sponge or open-cell foam gasketing material or if they are formed by vinyl extrusions or the like.

Examples of prior art air flow control mechanisms are shown in the U.S. Foster Patent No. 3,366,141; the U.S. Foster Pat. No. 3,495,521; the U.S. McCabe Pat. No. 3,908,529; and the U.S. Graham Pat. No. 4,038,781.

SUMMARY OF THE INVENTION

The invention provides an air valve or other air flow control mechanism of the type for use in air ducts in heating and air conditioning units and wherein means are provided for preventing noise generation due to air flow between closely adjacent surfaces of air flow controlling blades. The noise preventing means includes the application of strips of a fabric material to at least one of the adjacent surfaces of the air flow control means, the material functioning to disrupt sound waves impinging against that surface and preventing reflection of those waves and thereby preventing the formation of a standing wave between the adjacent surfaces.

More particularly, the invention includes an air flow control mechanism for use in an air duct for controlling air flow through the air duct, the air flow control mechanism including a frame positionable in the duct, and a member supported by the frame and having a first flow controlling surface. The air flow control mechanism also includes a moveable member supported by the frame and having a second flow controlling surface, the moveable member being supported such that the second flow controlling surface is moveable through a range of movement toward and away from the first flow controlling surface. Means are also provided for moving the moveable member so that the second flow controlling surface moves toward and away from the first flow controlling surface. Means are additionally provided for preventing the formation of high frequency noise caused by air flow between the flow controlling surfaces and including means for preventing the formation of high frequency standing waves between the flow controlling surfaces as the second movable member surface moves through its range of movement.

The noise preventing means includes a substrate bonded to one of the flow controlling surfaces and a large number of closely adjacent fibers supported by the substrate to form a short nap pile wherein the fibers extend generally toward the other of the flow controlling surfaces and prevent reflection of air waves impinging upon the flow controlling surface supporting the substrate.

Various other features and advantages of the invention are set forth in the following description, in the drawings and in the claims.

Figure 1:
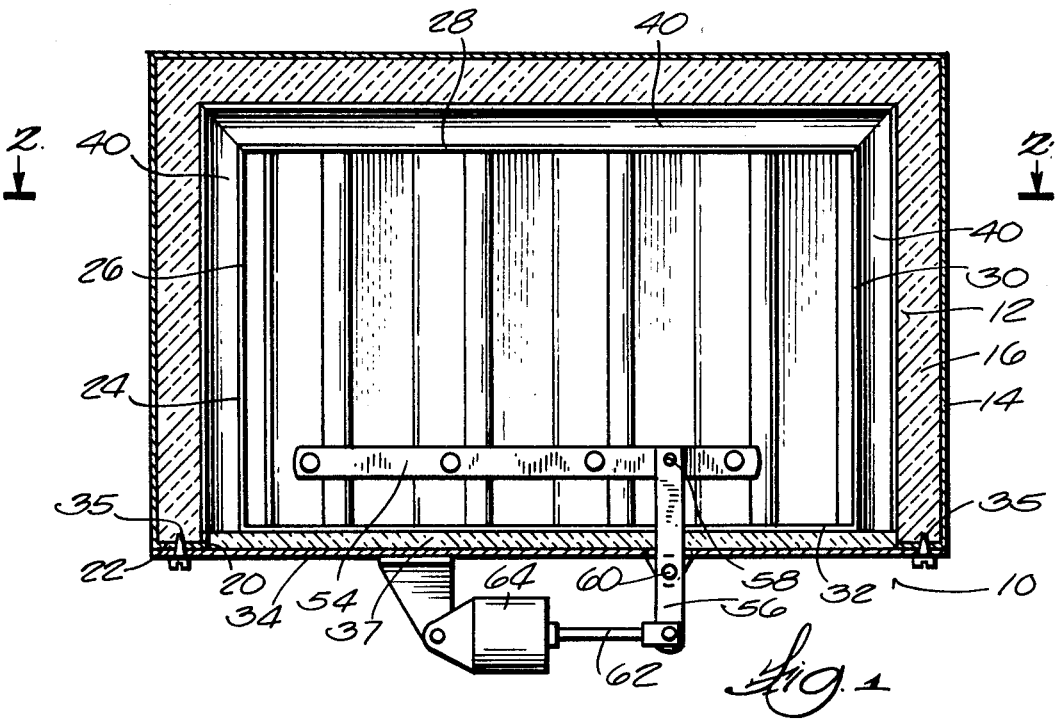
FIG. 1 is a cross section elevation view of an air duct including an air valve therein, the air valve embodying the present invention.

Before describing at least one embodiment of the invention in detail, it is to be understood that the invention is not limited in its application to the details of construction or the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Figure 2:
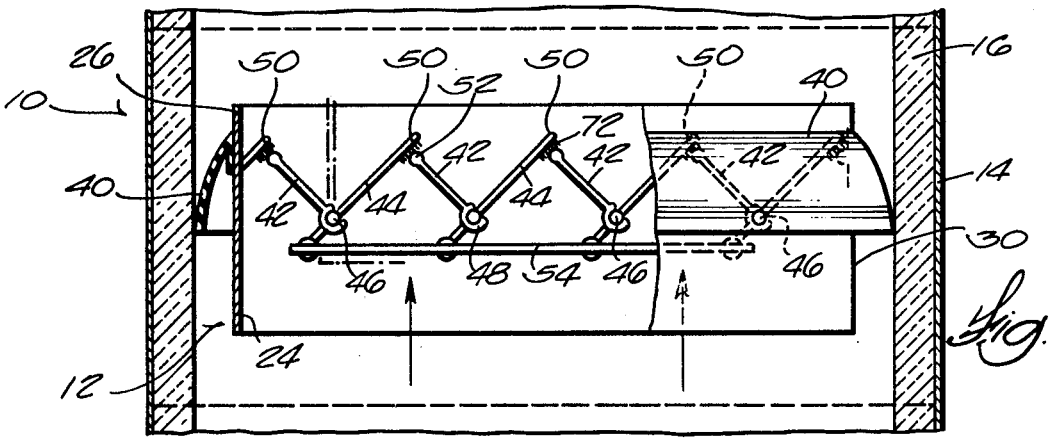
FIG. 2 is a cross section plan view taken along line 2—2 in FIG. 1.

Illustrated in FIGS. 1 and 2 is an air duct 10 of the type commonly employed in air conditioning and heating systems and housing an air valve 12 therein, the air valve 12 being provided to facilitate the control of the air flow through the air duct 10. The air duct 10 is comprised of a sheet metal housing 14 or the like having a layer of asbestos matting insulation 16 bonded to the inner service of the housing 14 and surrounding the inner surface. The asbestos matting is intended in part to provide thermal insulation for the air duct to restrict heat exchange between the air flowing through the air duct and the ambient air surrounding the air duct.

While the air valve 12 can have various configurations, in the illustrated construction, the air valve 12 is adapted to be freely slidably inserted into the air duct 10 through a rectangular aperture 20 cut in the bottom wall of 22 of the air duct. The air valve 12 is generally comprised of a rectangular sheet metal housing 24 including side walls 26, 28, 30 and 32, the sheet metal housing 24 being open at its opposite ends. The housing 24 is intended to be somewhat smaller than the interior of the air duct such that the housing 24 can be slidably positioned in the air duct. The air valve 12 also includes a flange plate 34 secured to the side wall 32 of the housing 24, the flange plate 34 including outwardly extend peripheral edges intended to overlap the edges of the rectangular opening or aperture 20 in the bottom wall of the air duct and whereby the air valve 14 can be secured to the duct by screws 35.

In the preferred embodiment of the invention, a layer of insulation material 37 is sandwiched between the side wall 32 of the housing 24 and the flange plate 34 to thereby retard heat transfer from the air duct and to compensate for removal of a section of insulation adjacent the rectangular aperture 20.

It should be recognized that while the air valve is illustrated as being slidably inserted through an aperture 20 in the bottom wall of the air duct 10, the air valve could similarly be received through apertures in either of the side walls or in the top wall of the air duct.

Means are also provided for forming a seal between the outer surface of the air valve housing 24 and the inside surface of the insulation layer of the air duct. While various sealing means could be provided, in the illustrated construction the sealing means includes elongated resilient gaskets 40 extending outwardly from the side walls 26, 28 and 30 and contacting the inside surface of the insulation layer.

The air valve 14 further includes a plurality of generally parallel blades 42 and 44 disposed in the rectangular opening defined by the walls 26, 28, 30 and 32 and functional to limit or control the air flow through the air duct. While the blades 42 and 44 may have various configurations and may be supported in various ways, in the illustrated construction, the parallel blades comprise a first set of parallel spaced apart stationary blades 42, rigidly supported at their opposite ends by the spaced walls 28 and 32. The stationary blades are substantially planar and are each supported at an upper end by the wall 28 and at a lower end by the wall 32. The air valve 14 also includes a plurality of pivotable blades 44, each pivotable blade 44 being supported between a pair of the stationary blades 42 and defining an elongated structure similar to that of the stationary blades. These pivotable blades 44 each have an upper end closely adjacent the upper wall 28 of the housing and a lower end closely adjacent the lower wall 32 of the housing. The pivotable blades 44 are each supported for pivotal movement about an axis 46 and are respectively pivotably attached to an edge of one of the stationary blades by a hinged connection 48 and their other edge 50 is movable through an arcuate path toward and away from an opposed edge 52 of an adjacent stationary blade 42, thereby providing for variation of the air flow through the air valve.

Means are also provided for causing pivotal movement of the movable blades 44 from the position wherein their edges 50 are spaced from respective adjacent surfaces 52 of adjacent stationary blades 42 to a position wherein a portion of each the movable blades 44 is in closely adjacent position to a surface of the opposed stationary blade 42. Such means comprise an enlongated translationally movable bar 54 pivotably connected to the movable blades 44 and means for causing translational movement of the translationally movable bar. In the illustrated construction, the means for causing translational movement is a lever 56 having one end pivotably connected by a pin 58 to one end of the translationally movable bar 54. The lever 56 is also connected by a pivot pin 60 at a point intermediate its opposite ends to the housing 24. The end of the lever opposite that end connected to the translationally movable bar 52, is pivotably connected to a translationally movable actuating rod 62 projecting from an actuator 64. While the actuator 64 can have various configurations, in the illustrated construction, the actuator 64 comprises a pneumatically operated piston and cylinder, the actuator rod forming the piston rod of the piston and cylinder.

In air valves of the type shown in the drawings and described above, when the movable air blades are pivoted to a position where one surface thereof is closely adjacent a surface of one of the stationary blades, the air flowing between the adjacent surfaces tends to vibrate therebetween at a very high resonant frequency. Stated alternatively, a high frequency standing wave is generated between the adjacent surfaces by the air flow, thereby forming a high pitched tone or whistle.

Figure 3:
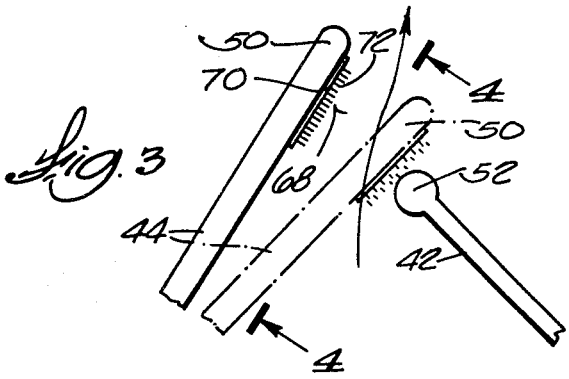
FIG. 3 is an enlarged partial view of the structure shown in FIG. 2.
Figure 4:
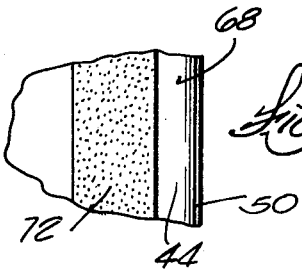
FIG. 4 is view taken along line 4—4 in FIG. 3.

In the air valve illustrated in the drawing, means are further provided for preventing reflection of such waves from one of the adjacent surfaces and thereby preventing formation of a standing wave therebetween and preventing the emmision of high frequency sound. The means for preventing such sound includes a fibrous material 68 (FIGS. 3 and 4) secured to at least one of the adjacent surfaces of the blades, the fiberous material 68 being so formed as to be sufficiently penetrated by the sound waves reflected from the opposed surface so as to prevent reflection of those waves. In the illustrated construction the fibrous material includes a fabric backing or substrate stip 70 bonded or otherwise secured to the surface of the blade 44 and supporting a short pile composition 72 comprised of closely adjacent short fibers extending transversly from the substrate and generally toward the surface of the opposed blade 44. In the preferred construction the fibrous material is employed in elongated strips on the order of $\frac{1}{4}$ inch to $\frac{1}{2}$ inch wide and extending along the entire length of that portion of the supporting blade 44 which is opposed to the edge of the adjacent blade 42.

It should be appreciated that while the fibrous material is shown as being bonded to a portion of the surface of the pivotable blade 44, it could also be bonded to the opposing surface of the stationary blade 42.

I claim:

1. An air flow control mechanism for use in an air duct for controlling air flow through the duct, the air flow control mechanism comprising a rectangular frame positionable in the duct, the frame defining a plane transverse to the direction of air flow through the duct, a member supported by said frame and having a first flow controlling surface, a movable member supported by said frame and having a second flow controlling surface, said movable member being pivotably supported so that said second flow controlling surface moves through a range of movement toward and away from said first flow controlling surface, means for pivoting said movable member so that said second flow controlling surface moves toward and away from said first flow controlling surface, and means for preventing the formation of high frequency noise caused by air flow between said flow controlling surfaces and for preventing the formation of high frequency standing waves between said flow controlling surfaces as said second movable member surface moves through its range of movement.

2. An air flow control mechanism as set forth in claim 1 wherein said noise preventing means includes a substrate bonded to one of said flow controlling surfaces and closely adjacent short fibers projecting from said substrate to form a short nap pile, said fibers extending generally toward the other of said flow controlling surfaces.

3. An air valve for use in an air duct for controlling air flow through the duct, said air valve comprising a frame positionable in said duct, a plurality of blades each supported by said frame for pivotal movement about an axis transverse to the direction of air flow through said air duct, the pivot axes of said blades being substantially parallel, one of said blades having an elongated surface movable toward and away from an elongated surface of another of said blades, and engageable with said elongated surface of said another of said blades, said surfaces being movable toward each other to restrict air flow through said duct, and means for preventing the generation of high frequency standing air waves between said surfaces.

4. An air valve for use in an air duct for controlling air flow through said duct, said air valve comprising a frame positionable in said duct, a plurality of blades each supported by said frame for pivotal movement about an axis transverse to the direction of air flow through the air duct, the pivot axes of said blades being spaced apart and substantially parallel, one of said blades having an elongated edge moveable toward and away from an elongated edge of another of said blades during pivotal movement of said blades, said edges moveable toward each other to restrict air flow through said duct, and means providing a discontinuous surface on one of said elongated edges and preventing resonant frequency air vibration between said edges.

5. An air valve as set forth in claim 4 wherein said means for providing a discontinuous surface includes material covering one of said edges, said material including a plurality of closely spaced fibers projecting away from said edge and transverse to said edge.

6. An air valve as set forth in claim 5 wherein said material comprises a substrate secured to said edge and a short napped pile bonded to said substrate, said pile comprised of closely adjacent short fibers extending transversely from said substrate and being bonded to said substrate.

7. An air valve for use in an air duct for controlling air flow through the duct, said air valve comprising a frame positionable in said duct, a plurality of blades each supported by said frame for pivotal movement about an axis transverse to the direction of air flow through said air duct, the pivot axes of said blades being substantially parallel, one of said blades having an elongated surface movable toward and away from an elongated surface of another of said blades, said surfaces being movable toward each other to restrict air flow through said duct, and means for preventing the generation of high frequency standing air waves between said surfaces including a substrate covering at least a portion of one of said surfaces, and a plurality of closely spaced fibers projecting from said substrate toward the other of said surfaces.

8. An air valve as set forth in claim 7, wherein said fibers form a short napped pile bonded to said substrate.

* * * * *